US007381233B2

(12) United States Patent
Oh et al.

(10) Patent No.: US 7,381,233 B2
(45) Date of Patent: Jun. 3, 2008

(54) DUST COLLECTING APPARATUS FOR VACUUM CLEANER

(75) Inventors: Jang-keun Oh, Gwangju (KR); Min-ha Kim, Gwangju (KR)

(73) Assignee: Samsung Gwangju Electronics Co., Ltd., Gwangju (KR)

( * ) Notice: Subject to any disclaimer, the term of this patent is extended or adjusted under 35 U.S.C. 154(b) by 0 days.

(21) Appl. No.: 11/646,636

(22) Filed: Dec. 28, 2006

(65) Prior Publication Data

US 2007/0289263 A1 Dec. 20, 2007

Related U.S. Application Data

(60) Provisional application No. 60/814,618, filed on Jun. 16, 2006.

(30) Foreign Application Priority Data

Jul. 24, 2006 (KR) ..... 10-2006-0069381

(51) Int. Cl.
*B01D 50/00* (2006.01)

(52) U.S. Cl. ..... 55/318; 55/337; 55/346; 55/349; 55/429

(58) Field of Classification Search ..... 55/DIG. 3, 55/318, 337, 346, 349, 429, 434, 452, 459.1, 55/465; D32/21, 31; 96/415, 416
See application file for complete search history.

(56) References Cited

U.S. PATENT DOCUMENTS 6,238,451 B1 * 5/2001 Conrad et al. ..... 55/323
6,436,160 B1 8/2002 Stephens et al. ..... 55/337
D462,489 S * 9/2002 Roberts et al. ..... D32/31
D468,069 S * 12/2002 Roberts et al. ..... D32/31
D469,226 S * 1/2003 Stephens ..... D32/31

(Continued)

FOREIGN PATENT DOCUMENTS

JP 2004-267680 9/2004

(Continued)

OTHER PUBLICATIONS

PCT International Search Report and Written Opinion dated May 3, 2007 corresponding to International Patent Application No. PCT/KR2007/000508.

*Primary Examiner*—Duane Smith
*Assistant Examiner*—Sonji Turner
(74) *Attorney, Agent, or Firm*—Ohlandt, Greeley, Ruggiero & Perle, LLP.

(57) ABSTRACT

A dust collecting apparatus for a vacuum cleaner, comprising a dust canister body, a part of which becomes an exposed side exposed outside a cleaner body upon mounting in the cleaner body, and which comprises a first dust separating chamber for separating heavy dirt from air, and second and third dust separating chambers for collecting fine dust from the air passing through the first dust separating chamber; first and second cyclone bodies having first and second cyclone chambers which separates the fine dust from the air passing through the first dust separating chamber; and first and second outlet pipes, wherein the first and second cyclone bodies are eccentrically disposed in the first and second dust separating chambers so as to form a protruded portion which is exposed from the exposed side of the dust canister body, and at least the protruded portion is made of a transparent material.

16 Claims, 3 Drawing Sheets

U.S. PATENT DOCUMENTS

| | | | | |
|---|---|---|---|---|
| 6,524,358 | B2 | 2/2003 | Yang | 55/337 |
| D477,443 | S * | 7/2003 | Kondo et al. | D32/21 |
| 6,613,129 | B2 | 9/2003 | Gen | 95/269 |
| 6,740,144 | B2 * | 5/2004 | Conrad et al. | 96/57 |
| 6,746,500 | B1 * | 6/2004 | Park et al. | 55/343 |
| D494,718 | S * | 8/2004 | Rosenzweig et al. | D32/31 |
| D494,719 | S * | 8/2004 | Rosenzweig et al. | D32/31 |
| D498,886 | S * | 11/2004 | Fujii | D32/21 |
| 6,840,972 | B1 | 1/2005 | Kim | 55/337 |
| 6,859,975 | B2 * | 3/2005 | Ohta et al. | 15/347 |
| 6,922,868 | B1 | 8/2005 | Jeong | 15/353 |
| 7,097,680 | B2 | 8/2006 | Oh | 55/343 |
| D528,721 | S * | 9/2006 | Santiago et al. | D32/31 |
| D529,247 | S * | 9/2006 | Carlito | D32/31 |
| 2006/0090428 | A1 | 5/2006 | Park et al. | 55/337 |
| 2006/0137304 | A1 | 6/2006 | Jeong et al. | 55/337 |
| 2006/0277874 | A1 | 12/2006 | Yoo | 55/429 |

FOREIGN PATENT DOCUMENTS

| | | |
|---|---|---|
| JP | 2005-102893 | 4/2005 |
| KR | 1020020072007 | 9/2002 |
| KR | 102005-0108623 | 11/2005 |
| KR | 102006-0031446 | 4/2006 |
| KR | 102006-0037989 | 5/2006 |

* cited by examiner

DUST COLLECTING APPARATUS FOR VACUUM CLEANER

RELATED APPLICATIONS

The present disclosure claims priority to U.S. Provisional Patent Application Ser. No. 60/814,618, filed on Jun. 16, 2006, and Korean Patent Application No. 2006-0069381, filed on Jul. 24, 2006, which are incorporated herein in their entireties.

BACKGROUND

1. Field

The present disclosure relates to a dust collecting apparatus for a vacuum cleaner, and more particularly to a dust collecting apparatus which can separate large-sized dirt and fine dust through a multi-stage process.

2. Description of the Related Art

A dust collecting apparatus provided in a vacuum cleaner separates dirt and dust from sucked external air. Recently, a so-called cyclone dust collecting apparatus which does not use a dust envelope and can be used semipermanently has been widely used. In the dust collecting apparatus, the dust contained in the sucked air is separated due to a difference in centrifugal force between the air and the dust caused by rotating the air.

A conventional dust collecting apparatus in which the dust contained in the sucked air is separated through a multi-stage process is disclosed in Korean Laid-Open Patent Publication No. 2000-0074149. The conventional dust collecting apparatus has a two-divided structure that the dust is separated firstly in a first dust collecting chamber by using the force of gravity and then separated secondarily in a second dust collecting chamber by using centrifugal force. Also, the dust collecting apparatus has a separate filter between the first and second dust collecting chambers.

However, in the conventional dust collecting apparatus, since an air suction part of the first dust collecting chamber and an exhaust part of the second cyclone dust collecting chamber are positioned collinearly, there is a disadvantage that it can not expect to obtain proper dust collecting efficiency without the filter. Further, another problem is that the filter should be periodically cleaned to remove the dust and dirt attached on the filter, since the dust and dirt are attached and accumulated on the filter.

Further, since the conventional dust collecting apparatus has a single cyclone chamber and thus has a suction and exhaust flow path having a narrow sectional area, it can not expect to obtain a high suction force and it is also apprehended that the suction force is further lowered when the filter is choked up with the dust and dirt.

Furthermore, in the conventional dust collecting apparatus, since the first and second dust collecting chambers are not visible from the outside, when the dirt sucked in the dust collecting apparatus has a large size, the user can not know where the large-sized dirt is caught in the collecting apparatus. In order to check where the large-sized dirt is caught in the collecting apparatus, the user has to stop the operation of the vacuum cleaner and separate the dust collecting apparatus from a cleaner body and open a cover and then check the inside of the dust collecting apparatus.

SUMMARY

An aspect of embodiments of the present disclosure is to solve at least the above problems and/or disadvantages and to provide at least the advantages described below. Accordingly, an aspect of embodiments of the present disclosure is to provide a dust collecting apparatus which can improve a dust separating efficiency without a filter disposed between a dirt separating chamber in which dirt is separated primarily and a cyclone chamber in which fine dust is separated secondarily.

Another aspect of embodiments of the present disclosure is to provide a dust collecting apparatus which is provided with a dual cyclone chamber so as to secure a wider sectional area of a suction and exhaust flow path of the cyclone chamber, thereby being capable of obtaining a high suction force.

Yet another aspect of embodiments of the present disclosure is to provide a dust collecting apparatus which can ensure visibility for observing the dust separating chamber and the cyclone chamber disposed in the dust collecting apparatus from the outside even during the operation of the vacuum cleaner without separating the dust collecting apparatus from the vacuum cleaner.

In order to achieve the above-described and other aspects of embodiments of the present disclosure, there is provided a dust collecting apparatus which is detachably coupled with a vacuum cleaner, comprising a dust canister body, a part of which becomes an exposed side exposed outside a cleaner body upon mounting in the cleaner body, and which comprises a first dust separating chamber for separating heavy dirt from air flowed in through an inlet port formed at one side thereof by using inertia and gravity, and second and third dust separating chambers, which are isolated from the first dust separating chamber, for collecting fine dust from the air passing through the first dust separating chamber; first and second cyclone bodies having first and second cyclone chambers which are respectively communicated with the first dust-separating chamber and separates the fine dust from the air passing through the first dust separating chamber by using centrifugal force generated when the air is rotated; and first and second outlet pipes which are respectively protruded from lower surfaces of the first and second cyclone bodies to upper sides of the first and second cyclone chambers, wherein the first and second cyclone bodies are eccentrically disposed in the first and second dust separating chambers so as to form a protruded portion which is exposed from the exposed side of the dust canister body, and at least the protruded portion is made of a transparent material to see through the cyclone chamber.

In order to achieve the above-described and other aspects of embodiments of the present disclosure, there is provided a dust collecting apparatus which is detachably coupled with a vacuum cleaner, comprising a dust canister body, a part of which becomes an exposed side exposed outside a cleaner body upon mounting in the cleaner body, and which comprises a first dust separating chamber for separating heavy dirt from air flowed in through an inlet port formed at one side thereof by using inertia and gravity, and second and third dust separating chambers, which are isolated from the first dust separating chamber, for collecting fine dust from the air passing through the first dust separating chamber; first and second cyclone bodies having first and second cyclone chambers which are respectively communicated with the first dust separating chamber and separates the fine dust from the air passing through the first dust separating chamber by using centrifugal force generated when the air is rotated; and first and second outlet pipes which are respectively protruded from lower surfaces of the first and second cyclone bodies to upper sides of the first and second cyclone chambers, wherein the first and second cyclone bodies are eccentrically disposed in the first and second dust separating chambers so that a portion of each of the first and second cyclone bodies has a common portion contacted with a portion of the exposed side of the dust canister body, and at least the common portion is made of a transparent material to see through the first and second cyclone chambers.

Preferably, all of the first and second cyclone bodies may be made of the transparent material, and the first dust separating chamber and the second and third dust separating chambers are isolated from each other by a first partition wall and the second and third dust separating chambers are isolated from each other by a second partition wall, and at least a part of each of the first and second partition walls is made of the transparent material.

Preferably, the first dust separating chamber is provided with an inertia blocking plate which is arranged at a position corresponding to the inlet port of the dust canister body so that the dirt flowed through the inlet port in the first dust separating chamber is collided with the inertia blocking plate at an early stage that the air is flowed in the first dust separating chamber and then fallen down by gravity. In this case, the inertia blocking plate is protruded from an inner circumference of the first dust separating chamber and then bent to a gravity direction, or protruded outside the first dust separating chamber and the inlet port may be formed at a side of the inertia blocking plate.

Preferably, the first and second cyclone chambers further comprise first and second spiral guides for increasing rotational force of the air flowed in the first and second cyclone chambers, and the first and second spiral guides are tinted with a brighter color than the first and second cyclone bodies in order to clearly see the dirt flowed in the first and second cyclone chambers.

In order to achieve yet another feature of the present disclosure, there is provided a dust collecting apparatus which is detachably coupled with a vacuum cleaner, comprising a dust canister body, a part of which becomes an exposed side exposed outside a cleaner body upon mounting in the cleaner body, and which comprises a first dust separating chamber for separating heavy dirt from air flowed in through an inlet port formed at one side thereof by using inertia and gravity, and second and third dust separating chambers, which are isolated from the first dust separating chamber, for collecting fine dust from the air passing through the first dust separating chambers, and which is made of a transparent material so as to see through all of the first, second and third dust separating chambers; first and second cyclone bodies having first and second cyclone chambers which are respectively communicated with the first dust separating chamber and separates the fine dust from the air passing through the first dust separating chamber by using centrifugal force generated when the air is rotated, and which is made of a transparent material so as to see through the first and second cyclone chambers; and first and second outlet pipes which are respectively protruded from lower surfaces of the first and second cyclone bodies to upper sides of the first and second cyclone chamber.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF EXEMPLARY EMBODIMENTS

Figure 1:
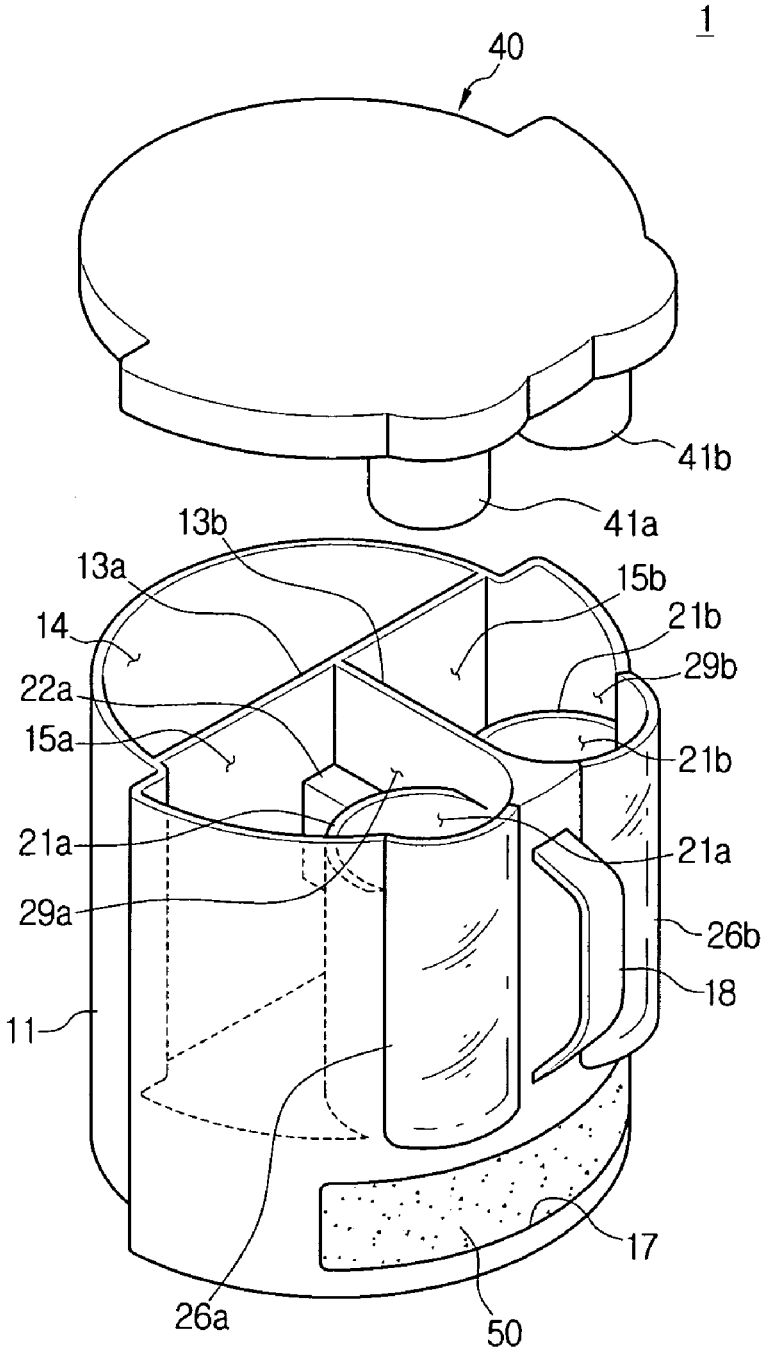
FIG. 1 is a perspective view of a dust collecting apparatus for a vacuum cleaner according to a first embodiment of the present disclosure.

Reference will now be made in detail to the present embodiments of the present disclosure, examples of which are illustrated in the accompanying drawings, wherein like reference numerals refer to the like elements throughout. The embodiments are described below in order to explain the present disclosure by referring to the figures.

Figure 2:
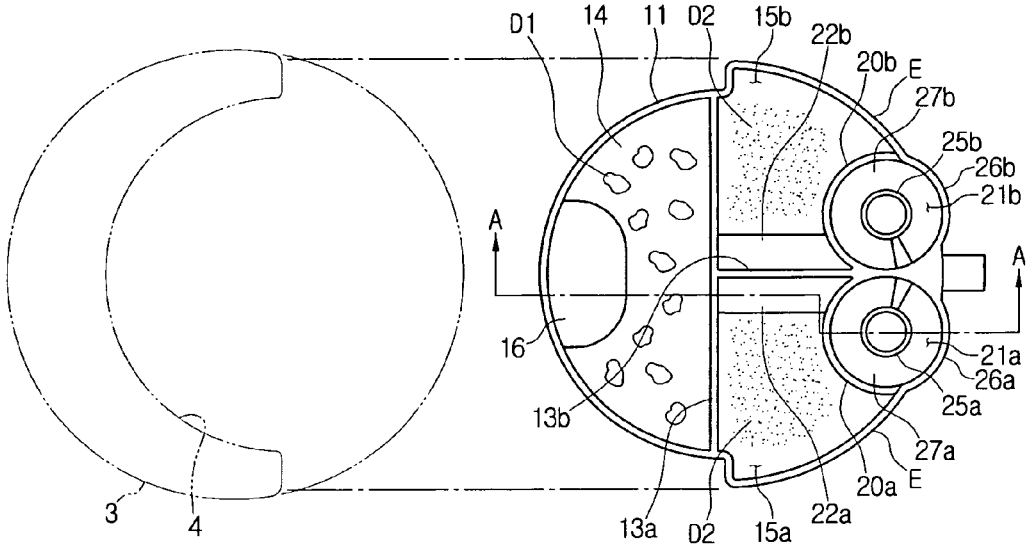
FIG. 2 is a plan view of the dust collecting apparatus in which a cover shown in FIG. 1 is removed.
Figure 3:
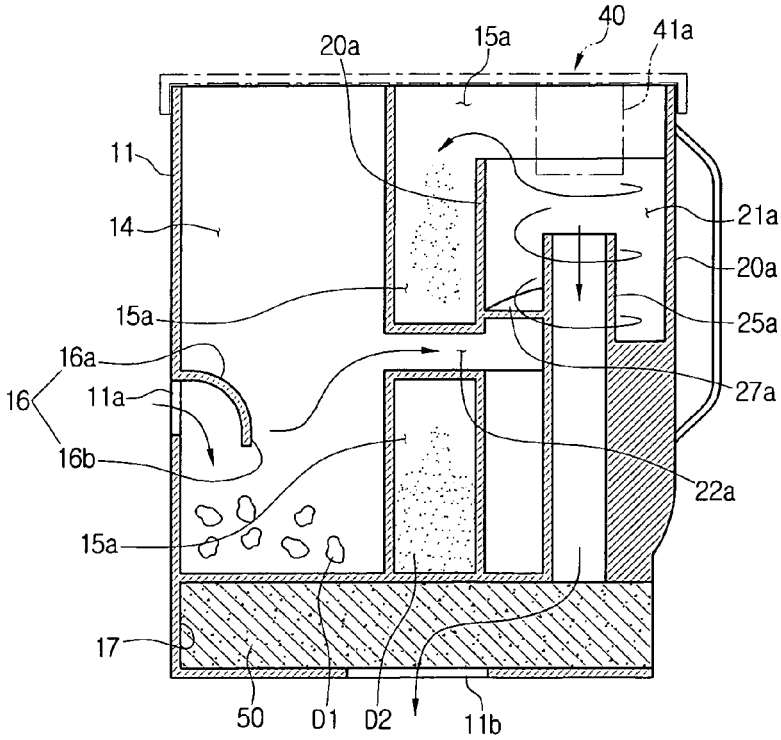
FIG. 3 is a cross-sectional view taken along a line A-A of FIG. 2.

FIG. 1 is a perspective view of a dust collecting apparatus for a vacuum cleaner according to a first embodiment of the present disclosure, FIG. 2 is a plan view of the dust collecting apparatus in which a cover shown in FIG. 1 is removed and FIG. 3 is a cross-sectional view taken along a line A-A of FIG. 2.

As shown in FIGS. 1 and 2, the dust collecting apparatus 1 according to the first embodiment of the present disclosure includes a dust canister body 11, first to third dust separating chambers 14, 15*a* and 15*b*, an inertia blocking plate 16, first and second cyclone bodies 20*a* and 20*b* and a cover 40.

As shown in FIG. 3, when a rear side of the dust canister body 11 is disposed at a concaved part 4 of a cleaner body 3, a front side of the dust canister body 11 becomes an exposed side E which is exposed to the outside of the cleaner body 3. The dust canister body 11 is formed with an inlet port 11*a*, through which air is flowed in, at the rear side thereof. In this case, the inlet port 11*a* is connected with a suction brush (not shown) of the vacuum cleaner so as to function as a path for guiding the external air containing the dust and dirt to the first dust separating chamber 14. Further, the dust canister body 11 has a handle 18 at the exposed side E so as to attach or detach the dust collecting apparatus 1 to/from the concaved part 4 of the cleaner body 3. Furthermore, a filter inserting slot 17 through which a filter 50 is inserted is formed at a lower side of the dust canister body 11. In this case, an upper side of the filter inserting slot 17 is communicated with lower sides of first and second outlet pipes 25*a* and 25*b* to be disclosed later, and a lower side thereof is formed with an outlet port 11 b through which the air passing through the first and second outlet pipes 25*a* and 25*b* and the filter 50 is exhausted. The filter 50 serves to filter again the cleaned air in which the dirt and dust is separated in the first dust separating chamber 14 and the first and second cyclone bodies 20*a* and 20*b*. In one preferred embodiment, the dust collecting apparatus 1 can be used even when the filter 50 is removed from the filter inserting slot 17.

The first to third dust separating chambers 14, 15*a* and 15*b* are divided to be isolated from each other in the dust canister body 11. In this case, the first dust separating chamber 14 and the second and third dust separating chambers 15*a* and 15*b* are isolated by a first partition wall 13*a* which divides an inner space of the dust canister body 11 into a front space and a rear space, and the second and third dust separating chambers 15*a* and 15*b* are isolated by a second partition wall 13*b* which divides the front space of the dust canister body 11 into a right space and a left space. Therefore, each of the second and third dust separating chambers 15*a* and 15*b* has a smaller space than the first dust separating chamber 14. The first dust separating chamber 14 is communicated with the inlet port 11*a*, and the inertia blocking plate 16 is formed to be protruded to the inside of the first dust separating chamber 14 at a position corresponding to the inlet port 11*a*. In this case, the first dust separating chamber 14 is the space for primarily collecting large-sized dirt D1 separated from the air sucked through the inlet port 11*a* by using the inertia blocking plate 16. The detailed description of the inertia blocking plate 16 will be provided later. The first and second cyclone bodies 20*a* and 20*b* in which the sucked air is rotated and risen up to generate centrifugal force and thus the fine dust D2 is separated from the sucked air by the centrifugal force are eccentrically disposed inside the second and third dust separating chambers 15*a* and 15*b*, respectively. Therefore, the fine dust D2 separated by the first and second cyclone bodies 20*a* and 20*b* is collected in the second and third dust collecting chamber 15*a* and 15*b*. Meanwhile, in the dust collecting apparatus 1 according to the first embodiment, the large-sized dirt D1 is separated primarily from the sucked air in the first dust separating chamber 14 by the inertia blocking plate 16, and the fine dust D2 is separated secondarily from the sucked air in the second and third dust separating chambers 15*a* and 15*b* by the first and second cyclone bodies 20*a* and 20*b*.

As shown in FIG. 3, one end 16*a* of the inertia blocking plate 16 is connected around the inlet port 11*a*, and the other end 16*b* is protruded to the inside of the first dust separating chamber 14 by a desired distance and then bent in the gravity direction. The other end 16*b* of the inertia blocking plate 16 is disposed to be correspondent with a moving direction of the large-sized dirt D1 flowed in through the inlet port 11*a*, and at the same time, is formed to have a larger area than the inlet port 11*a*. Therefore, the large-sized dirt D1 flowed with the air through the inlet port 11*a* in the first dust separating chamber 14 is continuously moved through inertia in an initial moving direction at the early stage and fallen down by gravity after colliding with the inertia blocking plate 16 and then collected in the first dust separating chamber 14.

The first and second cyclone bodies 20*a* and 20*b* are symmetrical about the second partition wall 13*b* and have the same structure. Therefore, only the first cyclone body 20*a* will be described hereinafter.

The first cyclone body 20*a* is provided with the cyclone chamber 21*a* in which the sucked air and the dirt contained in the air are rotated, and also includes an air inlet path 22*a*, first and second outlet pipes 15*a* and a spiral guide 27*a*. One end of the air inlet path 22*a* is communicated with the first dust separating chamber 14 and the other end is communicated with the cyclone chamber 21*a* so that the air inlet path 22*a* serves to guide the air flowed in the first dust separating chamber 14 to the cyclone chamber 21*a*. Preferably, the one end of the air inlet path 22*a* communicated with the first dust separating chamber 14 is formed at a higher position than the inlet port 11*a* of the dust canister body 11 so that the sucked air through the inlet port 11*a* is not directly flowed in the air inlet path 22*a*. This is to ensure an enough time and distance to separate the large-sized dirt D1 from the air passing through the inlet port 11*a* so that the large-sized dirt D1 which is not separated from the air yet is prevented previously from being flowed in the cyclone chamber 21*a*. The first outlet pipe 25*a* through which the primarily cleaned air is exhausted is protruded vertically to an upper side of the cyclone chamber 21*a*. The spiral guide 27*a* has a spiral structure that starts from a portion communicated with the air inlet path 22*a* and rises up while rounding an outer circumference of the first outlet pipe 25*a*. The spiral guide 27*a* functions to guide the air flowed in through the air inlet path 22*a* so that the air is risen up while being rotated around the first outlet pipe 25*a*. The first outlet pipe 25*a* serves as a liner path through which the secondarily cleaned air in the cyclone chamber 21*a* is exhausted to the outside of the dust collecting apparatus 1 and also as a central axis around which the air flowed through the air inlet path 22*a* in the cyclone chamber 21*a* is rotated.

Since the first and second cyclone chambers 21*a* and 21*b* have a dual structure, two air inlet paths 22*a* and 22*b* and two outlet pipes 25*a* and 25*b* are formed as the inlet paths and the outlet paths of the first and second cyclone chambers 21*a* and 21*b*, respectively. Therefore, it is possible to ensure wider sectional areas of the inlet paths and the outlet paths of the first and second cyclone chambers 21*a* and 21*b* in comparison with those in the conventional dust collecting apparatus, thereby providing a higher suction force.

As shown in FIGS. 1 and 2, the first and second cyclone bodies 20*a* and 20*b* are disposed eccentrically at the exposed side E of the dust canister body. Parts of the cyclone bodies 20*a* and 20*b* are disposed to be protruded from the dust canister body 11 to the outside so as to form protruded portions 26*a* and 26*b*. Preferably, the protruded portions 26*a* and 26*b* are formed of a transparent material so that the user can see the insides of the first and second cyclone chambers 21*a* and 21*b*. In this case, since the dust collecting apparatus 1 has the protruded portion 26*a* and 26*b*, the second and third dust separating chambers 15*a* and 15*b* can secure additional spaces for collecting the dust and dirt corresponding to the protruded portion 26*a* and 26*b*. Therefore, the second and third dust separating chambers 15*a* and 15*b* can becomes wider without separate expansion of a volume of the dust canister body 11, and thus it is possible to keep a compact structure of the dust collecting apparatus 1. In addition, since the protruded portions 26*a* and 26*b* are formed of the transparent material and thus the user can see the insides of the first and second cyclone bodies 20*a* and 20*b*, the user can see the dirt flowed through the spiral guides 27*a* and 27*b* in the cyclone chambers 21*a* and 21*b* with the naked eye by using the transparent protruded portions 26*a* and 26*b*. For example, when the large-sized dirt is jammed in the spiral guides 27*a* and 27*b* of the cyclone chambers 21*a* and 21*b*, the user can fix it all right promptly. Therefore, it is possible to previously prevent pressure loss in the cyclone chambers 21*a* and 21*b*. In this case, in order to further clearly find the dirt flowed in the cyclone chambers 21*a* and 21*b*, the spiral guides 27*a* and 27*b* may be tinted with a brighter color than the first and second cyclone bodies 20*a* and 20*b*. Further, if the whole parts of the first and second cyclone bodies 20*a* and 20*b* and the first partition wall 13*a* are formed of the transparent material, the user can get hold of the amount of large-sized dirt D1 and fine dust D2 collected in the first to third dust collecting chambers 14, 15*a* and 15*b* through the transparent first and second cyclone bodies 20*a* and 20*b* and first partition wall 13*a* and thus can know easily when the collected dirt and dust should be removed.

As shown in FIG. 3, the cover 40 is detachably disposed at an upper side of the dust canister body 11 to be apart from the first and second cyclone bodies 20*a* and 20*b* at a desired distance. Also the cover 40 is closely coupled with the upper side of the dust canister body 11 to close up the first to third dust separating chambers 14, 15*a* and 15*b*. Rotation guide members 41*a* and 41*b* are protruded at a lower surface of the cover 40, and setting positions of the rotation guide members 41 a and 41 b on the cover 40 are determined so that the rotational guide members 41*a* and 41*b* are respectively inserted into center portions of the pair of cyclone chambers 21*a* and 21*b* when the cover 40 is coupled to the dust canister body 11. In the embodiment, the rotational guide members 41*a* and 41*b* are formed respectively into a pipe and functions to keep and increase a rotational force of the dirt which is rotated and risen up toward dust exhaust ports 29*a* and 29*b* formed respectively between the lower surface of the cover 40 and the first and second cyclone bodies 20*a* and 20*b*, thereby improving an exhaust efficiency to the dust exhaust ports 29*a* and 29*b*. According to the present disclosure as described above, it is prevented that the dirt and dust collected in the first to third dust separating chambers 14, 15*a* and 15*b* is stirred up or spilled out while the dust collecting apparatus 1 is separated from the cleaner body 3 and then moved to a place for dumping the dirt and dust.

Figure 4:
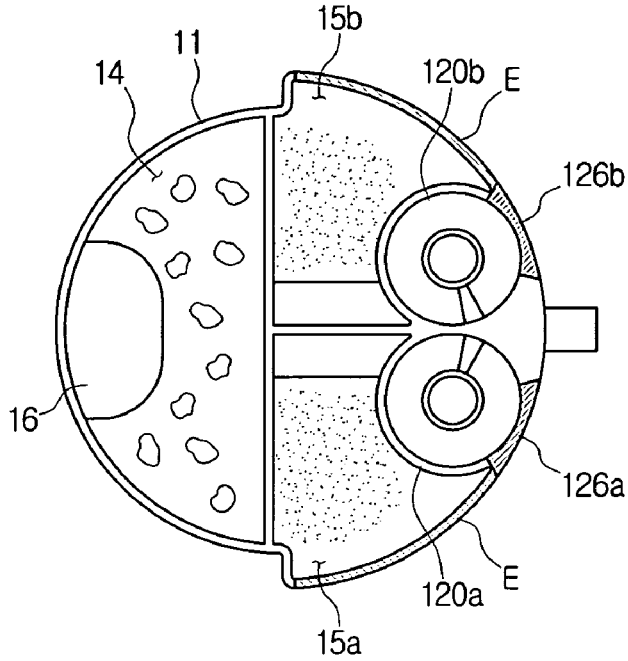
FIG. 4 is a plan view of the dust collecting apparatus for vacuum cleaner according to a second embodiment of the present disclosure.

FIG. 4 is a plan view of the dust collecting apparatus for vacuum cleaner according to a second embodiment of the present disclosure.

As shown in FIG. 4, the dust collecting apparatus according to the second embodiment has the same structure as in the first embodiment except the positions that the first and second cyclone bodies 120*a* and 120*b* are eccentrically disposed at the second and third dust separating chambers 15*a* and 15*b*. That is, the first and second cyclone bodies 120*a* and 120*b* are eccentrically disposed at one side of each dust separating chambers 15*a* and 15*b* so as to have common portions 126*a* and 126*b* which are integrally contacted with the exposed side E of the dust canister body 11. Like in the first embodiment, the user can facilely see the flow of the dirt and dust at the insides of the first and second cyclone bodies 120*a* and 120*b* through the common portions 126*a* and 126*b*.

Figure 5:
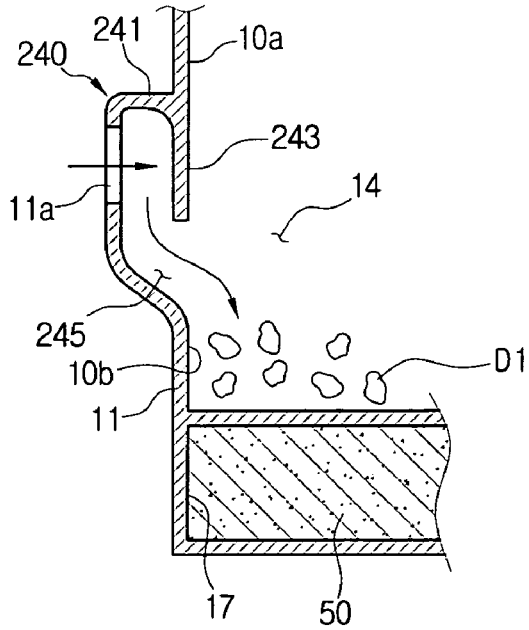
FIG. 5 is a partial cross-sectional view of the dust collecting apparatus for vacuum cleaner according to a third embodiment of the present disclosure.

FIG. 5 is a partial cross-sectional view of the dust collecting apparatus for vacuum cleaner according to a third embodiment of the present disclosure.

As shown in FIG. 5, the dust collecting apparatus according to the third embodiment has the same structure as in the first embodiment except the fact that a part 241 of the inertia blocking plate 240 is protruded to the outside of the dust canister body 11. That is, the part 241 of the inertia blocking plate 240 is protruded to the outside of the dust canister body 11 and formed with the inlet port 11*a*, and the other part 243 is formed to be extended vertically from an outer wall 10*a* of the dust canister body 11. At this time, a lower end of the other part 243 is apart from an outer wall 10*b* of the canister body 11 at a desired distance so as to form an inlet path 245 through which the air passing through the inlet port 11*a* is flowed in the first dust separating chamber 14.

In the embodiment as described above, when the dust canister body 11 is tilted to remove the dirt and dust collected in the first dust separating chamber 14, the discharged dirt and dust is prevented from being caught by the inertia blocking plate 240, allowing the dirt and dust to be discharged facilely.

According to the present disclosure as described above, since the dust collecting apparatus is provided with the inertia blocking plate for separately collecting large-sized dirt, and the cyclone chamber and the dust separating chamber are disposed in parallel to be isolated from each other, it is possible to improve dust collecting efficiency without a separate filter.

Further, the cyclone chambers have a dual structure so as to secure a wider sectional area of a suction and exhaust flow path of the cyclone chamber than in the conventional dust collecting apparatus, thereby being capable of obtaining a high suction force.

Furthermore, since the cyclone chamber has visibility for observing the inside thereof from the outside so that the user can see the flow of the dirt and dust with the naked eye during the operation of the vacuum cleaner, when the large-sized dirt is jammed in the cyclone chamber, the user can fix it all right promptly. Therefore, it is possible to previously prevent pressure loss in the dust collecting apparatus and thus prevent lowering of the suction force. Further, the user can get hold of the amount of dirt and dust collected in the first to third dust separating chambers without separating the dust collecting apparatus from the vacuum cleaner and thus can know easily when the collected dirt and dust should be removed.

In addition, since the cyclone body is formed to be protruded from the dust canister body to the outside and thus the space for collecting the dirt and dust is increased, it is possible to keep a compact structure of the dust collecting apparatus.

The foregoing embodiment and advantages are merely exemplary and are not to be construed as limiting the present disclosure. The present teaching can be readily applied to other types of embodiments. Also, the description of the embodiments of the present disclosure is intended to be illustrative, and not to limit the scope of the claims, and many alternatives, modifications, and variations will be apparent to those skilled in the art.

What is claimed is:

1. A dust collecting apparatus detachably coupled with a vacuum cleaner, the dust collecting apparatus comprising:

a dust canister body comprising:

an exposed side exposed outside the vacuum cleaner upon mounting in the vacuum cleaner;

a first dust separating chamber for separating heavy dirt from air flowed in through an inlet port formed at one side of the first dust separating chamber using inertia and gravity;

a second dust separating chamber and a third dust separating chamber, the second dust separating chamber and the third dust separating chamber being isolated from the first dust separating chamber, the second dust separating chamber and the third dust separating chamber collecting fine dust from the air passing through the first dust separating chamber;

a first cyclone body and a second cyclone body having first and second cyclone chambers, respectively, which are respectively communicated with the first dust separating chamber, the first and second cyclone bodies separating the fine dust from the air passing through the first dust separating chamber using centrifugal force generated when the air is rotated; and first and second outlet pipes which are respectively protruded from lower surfaces of the first and second cyclone bodies to upper sides of the first and second cyclone chambers, wherein the first and second cyclone bodies are eccentrically disposed in the first and second dust separating chambers so as to form a protruded portion which is exposed from the exposed side of the dust canister body, and wherein at least the protruded portion is made of a transparent material, and wherein the first dust separating chamber comprises an inertia blocking plate arranged at a position corresponding to the inlet port of the dust canister body so that the dirt flowing through the inlet port in the first dust separating chamber collides with the inertia blocking plate at an early stage of the air flow and is pulled downward by gravity.

2. The apparatus according to claim 1, wherein all of the first and second cyclone bodies are made of the transparent material.

3. The apparatus according to claim 1, wherein the first dust separating chamber and the second and third dust separating chambers are isolated from each other by a first partition wall and the second and third dust separating chambers are isolated from each other by a second partition wall, and at least a part of each of the first and second partition walls is made of the transparent material.

4. The apparatus according to claim 1, wherein the first and second cyclone chambers further comprise first and second spiral guides, respectively, for increasing rotational force of the air flowed in the first and second cyclone chambers, the first and second spiral guides being tinted with a brighter color than the first and second cyclone bodies in order to clearly see the dirt flowing in the first and second cyclone chambers.

5. The apparatus according to claim 1, wherein the inertia blocking plate protrudes from an inner circumference of the first dust separating chamber and is bent downward.

6. The apparatus according to claim 1, wherein the inertia blocking plate is protruded to an outside of the first dust separating chamber, and the inlet port is formed at a side of the inertia blocking plate.

7. A dust collecting apparatus detachably coupled with a vacuum cleaner, the dust collecting apparatus comprising:

a dust canister body comprising:

an exposed side exposed outside the vacuum cleaner upon mounting in the vacuum cleaner;

a first dust separating chamber separating heavy dirt from air flowed in through an inlet port formed at one side of the first dust separating chamber using inertia and gravity;

a second dust separating chamber and a third dust separating chamber, which are isolated from the first dust separating chamber, the second dust separating chamber and the third dust separating chamber collecting fine dust from the air passing through the first dust separating chamber;

first and second cyclone bodies having first and second cyclone chambers, respectively, which are respectively communicated with the first dust separating chamber the first and second cyclone bodies separating the fine dust from the air passing through the first dust separating chamber by using centrifugal force generated when the air is rotated; and first and second outlet pipes which are respectively protruded from lower surfaces of the first and second cyclone bodies to upper sides of the first and second cyclone chambers, wherein the first and second cyclone bodies are eccentrically disposed in the first and second dust separating chambers so that a portion of each of the first and second cyclone bodies has a common portion contacted with a portion of the exposed side of the dust canister body, and wherein at least the common portion is made of a transparent material, and wherein the first dust separating chamber is provided with an inertia blocking plate arranged at a position corresponding to the inlet port of the dust canister body so that the dirt flowing through the inlet port in the first dust separating chamber collides with the inertia blocking plate at an early stage of the air flow and is pulled downward by gravity.

8. The apparatus according to claim 7, wherein all of the first and second cyclone bodies are made of the transparent material.

9. The apparatus according to claim 7, wherein the first dust separating chamber and the second and third dust separating chambers are isolated from each other by a first partition wall and the second and third dust separating chambers are isolated from each other by a second partition wall, and at least a part of each of the first and second partition walls is made of the transparent material.

10. The apparatus according to claim 7, wherein the first and second cyclone chambers further comprise first and second spiral guides for increasing rotational force of the air flowed in the first and second cyclone chambers, and the first and second spiral guides are tinted with a brighter color than the first and second cyclone bodies in order to clearly see the dirt flowed in the first and second cyclone chambers.

11. The apparatus according to claim 7, wherein the inertia blocking plate protrudes from an inner circumference of the first dust separating chamber and is bent in a downward direction.

12. The apparatus according to claim 7, wherein the inertia blocking plate is protruded to an outside of the first dust separating chamber, and the inlet port is formed at a side of the inertia blocking plate.

13. A dust collecting apparatus detachably coupled with a vacuum cleaner, the dust collecting apparatus comprising:

a dust canister body comprising:

an exposed side exposed outside the vacuum cleaner upon mounting in the vacuum cleaner;

a first dust separating chamber separating heavy dirt from air flowed in through an inlet port formed at one side of the first dust separating chamber using inertia and gravity;

a second dust separating chamber and a third dust separating chamber, which are isolated from the first dust separating chamber, the second dust separating chamber and the third dust separating chamber collecting fine dust from the air passing through the first dust separating chambers, wherein the second and third dust separating chambers are made of a transparent material;

first and second cyclone bodies having first and second cyclone chambers, respectively, which are respectively communicated with the first dust separating chamber, the first and second cyclone chambers separating fine dust from the air passing through the first dust separating chamber using centrifugal force generated when the air is rotated, wherein the first and second cyclone chambers are made of a transparent material; and first and second outlet pipes which are respectively protruded from lower surfaces of the first and second cyclone bodies to upper sides of the first and second cyclone chambers, wherein the first dust separating chamber is provided with an inertia blocking plate arranged at a position corresponding to the inlet port of the dust canister body so that the dirt flowing through the inlet port in the first dust separating chamber collides with the inertia blocking plate at an early stage of the air flow and is pulled downward by gravity.

14. The apparatus according to claim 13, wherein the first and second cyclone chambers further comprise first and second spiral guides, respectively, for increasing rotational force of the air flowed in the first and second cyclone chambers, the first and second spiral guides being tinted with a brighter color than the first and second cyclone bodies in order to clearly see the dirt flowing in the first and second cyclone chambers.

15. The apparatus according to claim 13, wherein the inertia blocking plate is protruded from an inner circumference of the first dust separating chamber and then bent in a downward direction.

16. The apparatus according to claim 13, wherein the inertia blocking plate is protruded to an outside of the first dust separating chamber, and the inlet port is formed at a side of the inertia blocking plate.

* * * * *